US012241477B2

(12) United States Patent
Hayashi et al.

(10) Patent No.: US 12,241,477 B2
(45) Date of Patent: Mar. 4, 2025

(54) MULTI-BLADE CENTRIFUGAL AIR-SENDING DEVICE

(71) Applicant: Mitsubishi Electric Corporation, Tokyo (JP)

(72) Inventors: Hiroyasu Hayashi, Tokyo (JP); Takuya Teramoto, Tokyo (JP); Katsuhiro Fujiki, Tokyo (JP); Wahei Shingu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/043,917

(22) PCT Filed: Oct. 23, 2020

(86) PCT No.: PCT/JP2020/039898
§ 371 (c)(1),
(2) Date: Mar. 3, 2023

(87) PCT Pub. No.: WO2022/085175
PCT Pub. Date: Apr. 28, 2022

(65) Prior Publication Data

US 2024/0026899 A1 Jan. 25, 2024

(51) Int. Cl.
*F04D 29/30* (2006.01)
*F04D 17/08* (2006.01)
(Continued)

(52) U.S. Cl.
CPC ..... *F04D 29/4226* (2013.01); *F04D 17/08* (2013.01); *F04D 29/281* (2013.01)

(58) Field of Classification Search
None
See application file for complete search history.

(56) References Cited

U.S. PATENT DOCUMENTS 5,988,979 A * 11/1999 Wang ..... F04D 29/283 416/200 R
8,922,082 B2 * 12/2014 Kwon ..... F04D 25/0606 310/90
9,051,837 B2 * 6/2015 Chiu ..... F04D 29/188
(Continued)

FOREIGN PATENT DOCUMENTS

CN 101208523 A 6/2008
CN 205298053 U 6/2016
(Continued)

OTHER PUBLICATIONS

Office Action dated Oct. 17, 2023 issued in corresponding JP patent application No. 2022-556346 (and English translation).
(Continued)

*Primary Examiner* — Kayla Mccaffrey
(74) *Attorney, Agent, or Firm* — Posz Law Group, PLC

(57) ABSTRACT

A multi-blade centrifugal air-sending device includes an impeller including a back plate having a disk shape, a plurality of blades arranged at a peripheral portion of the back plate in a circumferential direction, and a rim having an annular shape and disposed to face the back plate, the rim fixing the plurality of blades; and a scroll casing having a spiral shape and housing the impeller, the scroll casing being configured such that air is introduced from the side of the rim and blown out to the outer peripheral side. The impeller is constituted by a metal. Each of the blades has a wall thickness constant from the side of the back plate to the side of the rim and extends toward the inner side further than an inner peripheral end of the rim.

3 Claims, 5 Drawing Sheets

(51) Int. Cl.
*F04D 29/28* (2006.01)
*F04D 29/42* (2006.01)

(56) References Cited

U.S. PATENT DOCUMENTS

| | | | | |
|---|---|---|---|---|
| 10,030,667 | B2 * | 7/2018 | Pirouzpanah | F04D 25/08 |
| 10,100,839 | B2 * | 10/2018 | Kasahara | F04D 29/283 |
| 11,236,762 | B2 * | 2/2022 | Jayarathne | F04D 29/4226 |
| 2009/0028713 | A1 | 1/2009 | Kikuchi et al. | |
| 2012/0201680 | A1 | 8/2012 | Hall et al. | |
| 2012/0315135 | A1 | 12/2012 | Sato et al. | |
| 2017/0234323 | A1 | 8/2017 | Pirouzpanah et al. | |

FOREIGN PATENT DOCUMENTS

| | | | |
|---|---|---|---|
| CN | 109268313 | A | 1/2019 |
| JP | H04-042300 | U | 4/1992 |
| JP | H09-256994 | A | 9/1997 |
| JP | 2000-145693 | A | 5/2000 |
| JP | 2000-240590 | A | 9/2000 |
| JP | 2002-357196 | A | 12/2002 |
| JP | 2012-036885 | A | 2/2012 |
| WO | 2019/082378 | A1 | 5/2019 |

OTHER PUBLICATIONS

Extended European Search Report dated Nov. 17, 2023 issued in corresponding EP patent application No. 20958725.2.
International Search Report of the International Searching Authority mailed Nov. 17, 2020 for the corresponding International Application No. PCT/JP2020/039898 (and English translation).
Office Action issued Jun. 9, 2021 in corresponding TW Patent Application No. 11020548230 (and English machine translation).

* cited by examiner

MULTI-BLADE CENTRIFUGAL AIR-SENDING DEVICE

CROSS-REFERENCE TO RELATED APPLICATION

This application is a U.S. National Stage Application of International Application No. PCT/JP2020/039898 filed on Oct. 23, 2020, the contents of which are incorporated herein by reference.

TECHNICAL FIELD

The present disclosure relates to a multi-blade centrifugal air-sending device including an impeller.

BACKGROUND

A multi-blade centrifugal air-sending device includes an impeller and a scroll casing having a spiral shape and housing the impeller. The impeller is constituted by a back plate, a rim having an annular shape and facing the back plate, and a plurality of blades provided between the back plate and the rim. The impeller sucks air from the side of the rim by rotating and causes the air to flow out to an air passage in the inside of the scroll casing through a gap between blades. The airflow is pressurized in the air passage in the inside of the scroll casing and blown out through a discharge port. As a means for increasing the air volume in the multi-blade centrifugal air-sending device, there is a method of increasing the number of the blades. When the number of the blades is increased to increase the air volume, however, noise is increased due to the increase in the number of the blades. Thus, there is a device (refer to, for example, Patent Literature 1) in which a forward blade is provided on the outer peripheral side of a blade and a rearward blade is provided on the inner peripheral side of the blade to thereby increase the suction air volume with the rearward blade without increasing the number of blades. In the multi-blade centrifugal air-sending device disclosed in Patent Literature 1, the rearward blade provided on the inner peripheral side of the blade is configured to be disposed and exposed on the inner side of the inner peripheral end of a rim, and air is taken in by the exposed rearward blade. An impeller in the multi-blade centrifugal air-sending device in Patent Literature 1 is formed with a resin material by injection molding.

PATENT LITERATURE

Patent Literature 1: Japanese Unexamined Patent Application Publication No. 2012-36885

When an impeller is formed with a resin material by injection molding as in Patent Literature 1, however, the wall thickness of a blade is larger on the side of a back plate than on the side of a rim generally due to the moldability of the impeller, and a gap formed between blades is narrower on the side of the back plate than on the side of the rim in the impeller. Therefore, although the rearward blade is exposed from the inner peripheral end of the rim in the multi-blade centrifugal air-sending device in Patent Literature 1, it may be impossible on the side of the back plate to sufficiently take air that has reached the vicinity of the rearward blade into the gap between the blades and may be impossible on the side of the back plate in the impeller to obtain an effect of increasing the suction air volume.

SUMMARY

The present disclosure has been made to solve the aforementioned problem, and an object of the present disclosure is to provide a multi-blade centrifugal air-sending device capable of increasing the suction air volume on the side of a back plate in an impeller, compared with a multi-blade centrifugal air-sending device constituted by a resin material as in the related art.

A multi-blade centrifugal air-sending device according to the present disclosure includes an impeller including a back plate having a disk shape, a plurality of blades arranged at a peripheral portion of the back plate in a circumferential direction, and a rim having an annular shape and disposed to face the back plate, the rim fixing the plurality of blades; and a scroll casing having a spiral shape and housing the impeller, the scroll casing being configured such that air is introduced from the side of the rim and blown out to the outer peripheral side. The impeller is constituted by a metal. Each of the blades has a wall thickness constant from the side of the back plate to the side of the rim and extends toward the inner side further than an inner peripheral end of the rim.

According to the present disclosure, since the impeller is constituted by a metal, and the wall thickness of each of the blades is constant from the side of the rim to the side of the back plate, a gap between blades similar to that on the side of the rim in the impeller can be ensured also on the side of the back plate in the impeller at a portion of each of the blades extending toward the inner side further than the inner peripheral end of the rim. Therefore, compared with a multi-blade centrifugal air-sending device constituted by a resin material as in the related art, the suction air volume can be increased also on the side of the back plate in the impeller.

DETAILED DESCRIPTION

Hereinafter, a multi-blade centrifugal air-sending device 100 according to an embodiment will be described with reference to the drawings. In the following drawings including FIG. 1, relative dimensional relationships, shapes, and others of constituent members may differ from actual ones. Members having identical signs in the following drawings are identical or correspond to each other, which is common to the entire content of the description. For ease of understanding, terms indicating directions (for example, "upper", "lower", "forward", "rearward", and the other similar terms) are used, as appropriate. These terms are, however, merely thus used for convenience of description and are not intended to limit the arrangements and orientations of a device or components.

Embodiment 1

Figure 1:
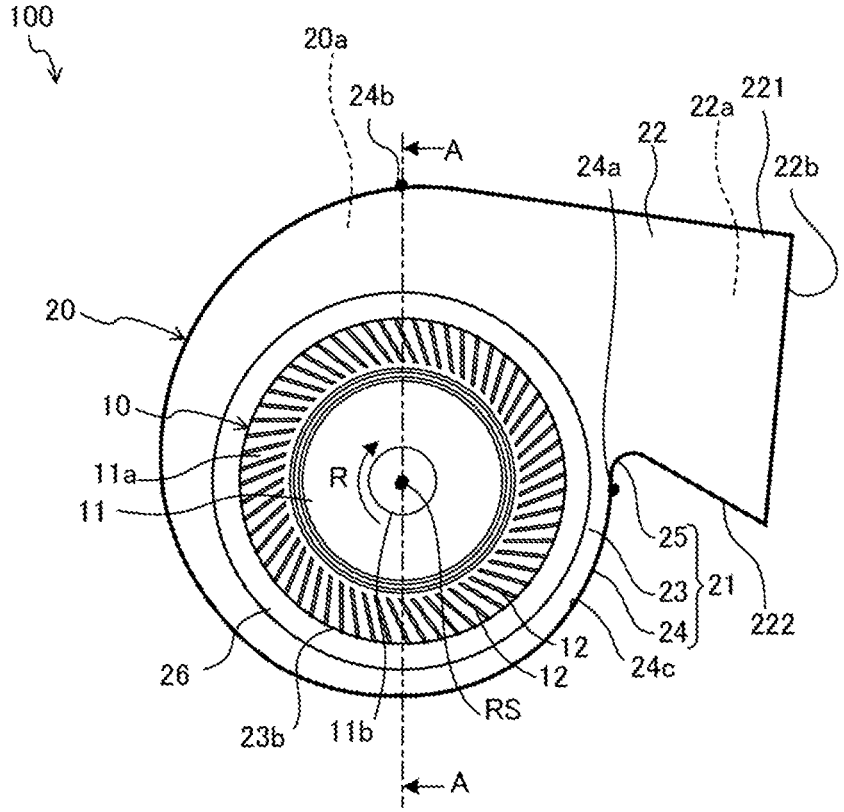
FIG. 1 is a schematic external view of a configuration of a multi-blade centrifugal air-sending device according to Embodiment 1 as viewed in a direction parallel to a rotational axis.
Figure 2:
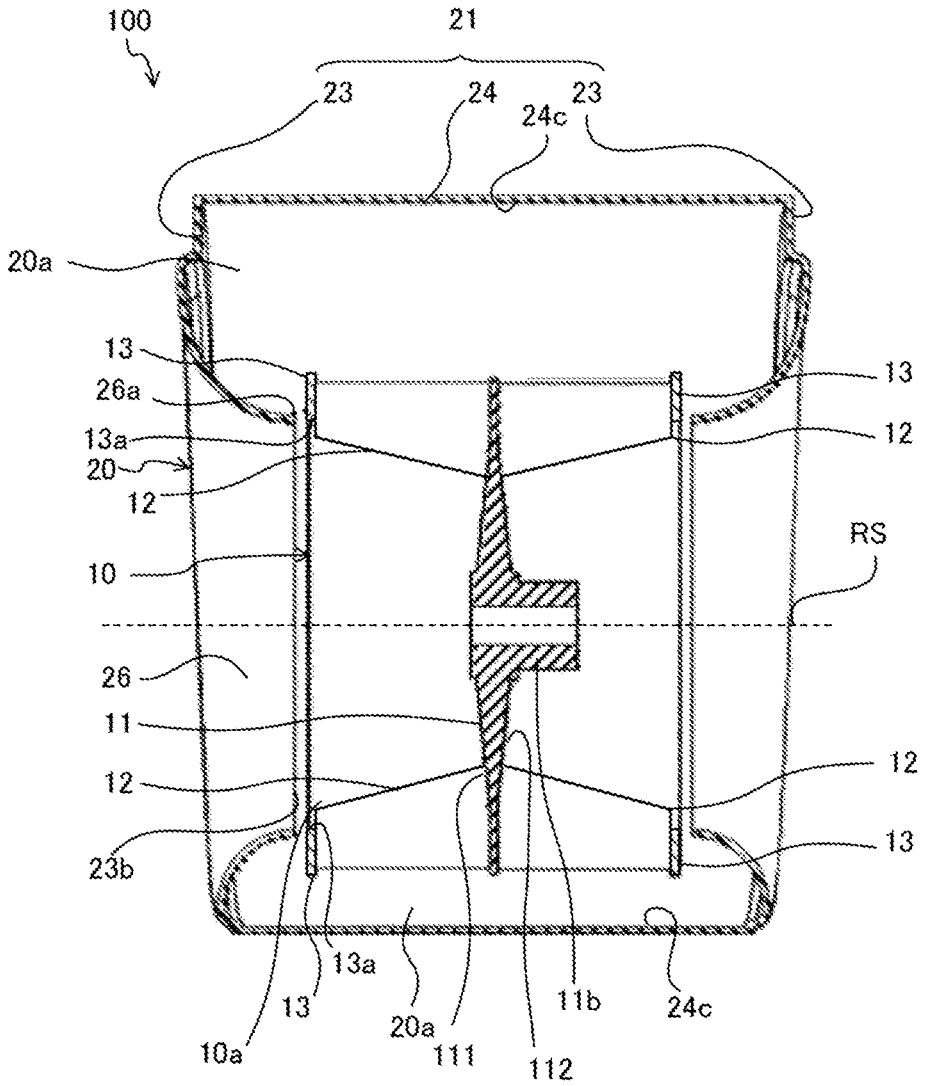
FIG. 2 is a sectional view in which a section of the multi-blade centrifugal air-sending device in FIG. 1 along line A-A is schematically illustrated.

FIG. 1 is a schematic external view of a configuration of the multi-blade centrifugal air-sending device 100 according to Embodiment 1 as viewed in a direction parallel to a rotational axis RS. FIG. 2 is a sectional view in which a section of the multi-blade centrifugal air-sending device 100 in FIG. 1 along line A-A is schematically illustrated. With reference to FIG. 1 and FIG. 2, a basic structure of the multi-blade centrifugal air-sending device 100 will be described.

As illustrated in FIG. 1, the multi-blade centrifugal air-sending device 100 is an air-sending device of a multi-blade centrifugal type and includes an impeller 10 that generates an airflow, and a scroll casing 20 that houses the impeller 10. The impeller 10 includes, as illustrated in FIG. 1, a back plate 11 having a disk shape, a plurality of blades 12 each having a uniform thickness, and a rim 13 having an annular shape as illustrated in FIG. 2. The back plate 11 is provided with a shaft portion 11*b* to which a motor (not illustrated) is connected. The plurality of blades 12 are arranged at a peripheral portion of the back plate 11 in the circumferential direction. The rim 13 is disposed to face the back plate 11 and fixes the plurality of blades 12.

As illustrated in FIG. 1, the scroll casing 20 includes a scroll portion 21 and a discharge portion 22 having a discharge port 22*b* for air, and rectifies an airflow blown out from the impeller 10 in the centrifugal direction. The scroll casing 20 has a spiral shape, and an air passage 20*a* expanding gradually toward the discharge port 22*b* is formed in the inside of the scroll casing 20.

The scroll portion 21 forms the air passage 20*a* that converts a dynamic pressure of the airflow generated by the rotation of the impeller 10 into a static pressure. The scroll portion 21 includes a side wall 23 covering the impeller 10 in the axial direction of an imaginary rotational axis RS of the impeller 10, and a peripheral wall 24 surrounding the impeller 10 from the outer side in the radial direction of the rotational axis RS. Each side wall 23 has an air inlet 23*b* through which air is sucked. The scroll portion 21 also includes a tongue portion 25 positioned between the discharge portion 22 and a winding start portion 24*a* of the peripheral wall 24 and constituting a curved surface. The tongue portion 25 is configured to guide the airflow blown out from the impeller 10 in the centrifugal direction in the vicinity of the winding start portion 24*a*, to be in a rotational direction R of the impeller 10 to move toward the discharge port 22*b* via the scroll portion 21.

The radial direction of the rotational axis RS is a direction perpendicular to the axial direction of the rotational axis RS. An internal space of the scroll portion 21 constituted by the peripheral wall 24 and the side wall 23 serves as the above-described air passage 20*a*. In the air passage 20*a*, the airflow blown out from the impeller 10 flows along the peripheral wall 24.

In the example illustrated in FIG. 2, the multi-blade centrifugal air-sending device 100 is a double-suction-type centrifugal air-sending device configured to suck air from both end sides in the axial direction of the imaginary rotational axis RS of the impeller 10. The side wall 23 are disposed on both sides of the impeller 10 in the axial direction of the rotational axis RS of the impeller 10. Each side wall 23 of the scroll casing 20 has the air inlet 23*b* to enable air to circulate between the impeller 10 and the outside of the scroll casing 20. As illustrated in FIG. 1, the air inlet 23*b* has a circular shape, and the impeller 10 is disposed in the scroll casing 20 such that the center of the air inlet 23*b* and the center of the shaft portion 11*b* of the impeller 10 substantially coincide with each other. The impeller 10 is supported about an axis by the scroll casing 20 to be rotatable.

As illustrated in FIG. 2, the scroll casing 20 is a casing of a double suction type having, on both sides of the back plate 11 in the axial direction of the rotational axis RS of the impeller 10, the side wall 23 having the air inlet 23*b*. The two side walls 23 are provided to face each other with the peripheral wall 24 interposed therebetween in the scroll casing 20.

As illustrated in FIG. 1, the air inlet 23*b* provided in each side wall 23 is formed by a bell mouth 26. That is, the bell mouth 26 forms the air inlet 23*b* in communication with a space formed by the back plate 11 and the plurality of blades 12 in the impeller 10. In the following description, the space formed by the back plate 11 and the plurality of blades 12 may be referred to as a flow passage 11*a* of the impeller 10.

As illustrated in FIG. 2, the bell mouth 26 rectifies the air sucked through the air inlet 23*b* of each side wall 23 and causes the air to flow into a central portion of the impeller 10 through an impeller air inlet 10*a*. The bell mouth 26 is provided to project from the side wall 23 toward the inside. More specifically, the bell mouth 26 is formed such that the opening diameter thereof decreases gradually from the side wall 23 of the scroll casing 20 toward the inside. With such a configuration, when the impeller 10 rotates, the air in the vicinity of the air inlet 23*b* of each side wall 23 flows smoothly along the bell mouth 26 and flows into the impeller 10 efficiently through the impeller air inlet 10*a*. The impeller air inlet 10*a* for causing a gas to flow into the flow passage 11*a* of the impeller 10 is provided on the side of the rim 13 in the impeller 10.

As illustrated in FIG. 1, the peripheral wall 24 is constituted by a wall surface curved in the rotational direction R of the impeller 10. The peripheral wall 24 is present, as illustrated in FIG. 2, between the two side walls 23 facing each other in the scroll casing 20 and is provided, as illustrated in FIG. 1, to connect portions of the outer peripheral edges of the two side walls 23 to each other. The peripheral wall 24 has a curved inner peripheral surface 24*c* and guides the airflow blown out to the air passage 20*a* in the scroll portion 21 from the impeller 10, so as to flow along the inner peripheral surface 24*c* to the discharge port 22*b*.

The peripheral wall 24 has a configuration in which the wall surface curved as illustrated in FIG. 1 extends parallel to the axial direction of the rotational axis RS of the impeller 10 as illustrated in FIG. 2. The peripheral wall 24 may have a form inclined with respect to the axial direction of the rotational axis RS of the impeller 10, and is not limited to having the form disposed parallel to the axial direction of the rotational axis RS.

As illustrated in FIG. 1, the peripheral wall 24 covers the impeller 10 from the outer side in the radial direction of the shaft portion 11*b* of the impeller 10, and the inner peripheral surface 24*c* of the peripheral wall 24 faces end portions of the plurality of later-described blades 12 on the outer peripheral side. That is, the inner peripheral surface 24*c* of the peripheral wall 24 faces the air blowing-out side of the blades 12 of the impeller 10. The peripheral wall 24 is provided to extend in the rotational direction R of the impeller 10 from the winding start portion 24*a* positioned at the boundary between the peripheral wall 24 and the tongue portion 25 to a winding end portion 24*b* positioned at the boundary between the discharge portion 22 and the scroll portion 21 on the side away from the tongue portion 25. The winding start portion 24*a* is, of the peripheral wall 24 constituted by the curved wall surface, an end portion on the upstream side of the airflow generated by the rotation of the impeller 10, and the winding end portion 24*b* is an end portion of the peripheral wall 24 on the downstream side of the airflow generated by the rotation of the impeller 10. More specifically, the peripheral wall 24 has a spiral shape. The spiral shape is, for example, a logarithmic spiral, an Archimedes' spiral, or a spiral shape based on an involute curve or any other curve. With such a configuration, the airflow blown out from the impeller 10 into the air passage 20*a* of the scroll casing 20 flows in the gap between the impeller 10 and the peripheral wall 24 smoothly to the direction of the discharge portion 22. Therefore, the static pressure of air increases in the rotational direction R of the impeller 10 from the tongue portion 25 toward the discharge portion 22 in the scroll casing 20.

The discharge portion 22 forms the discharge port 22*b* through which the airflow that has been generated by the rotation of the impeller 10 and passed through the air passage 20*a* of the scroll portion 21 is discharged. The discharge portion 22 is constituted by a hollow pipe whose section orthogonal to the flow direction of discharged air has a rectangular shape. The discharge portion 22 is constituted by, for example, plate-shaped four side surfaces. Specifically, the discharge portion 22 includes an extended plate 221 smoothly connected to the winding end portion 24*b* of the peripheral wall 24, and a diffuser plate 222 extending from the tongue portion 25 to face the extended plate 221. The discharge portion 22 also includes a first side wall portion and a second side wall portion (not illustrated) each extended from a corresponding one of the two side walls 23 to connect both ends of the extended plate 221 and the diffuser plate 222 in the axial direction of the rotational axis RS to each other. The sectional shape of the discharge portion 22 is not limited to a rectangular shape. The discharge portion 22 forms a discharge-side air passage 22*a* that guides the airflow discharged from the impeller 10 and flowing through the gap between the peripheral wall 24 and the impeller 10, to be discharged to the outside of the scroll casing 20.

The tongue portion 25 is formed between the diffuser plate 222 of the discharge portion 22 and the winding start portion 24*a* of the peripheral wall 24 in the scroll casing 20. The tongue portion 25 is formed to have a predetermined radius of curvature, and the peripheral wall 24 is smoothly connected to the diffuser plate 222 with the tongue portion 25 interposed therebetween. The tongue portion 25 suppresses the inflow of air from the winding end portion to the winding start portion of the spiral air passage 20*a* formed in the inside of the scroll casing 20. In other words, the tongue portion 25 has a role of separating the airflow flowing from an upstream portion of the air passage 20*a* in the rotational direction R of the impeller 10 and the airflow flowing from a downstream portion of the air passage 20*a* toward the discharge port 22*b* in a discharge direction from each other. The static pressure of the airflow flowing into the discharge-side air passage 22*a* of the discharge portion 22 increases while the airflow passes through the scroll casing 20, to be higher than in the scroll casing 20. The tongue portion 25 is thus configured to have a function of partitioning such different pressures.

Figure 3:
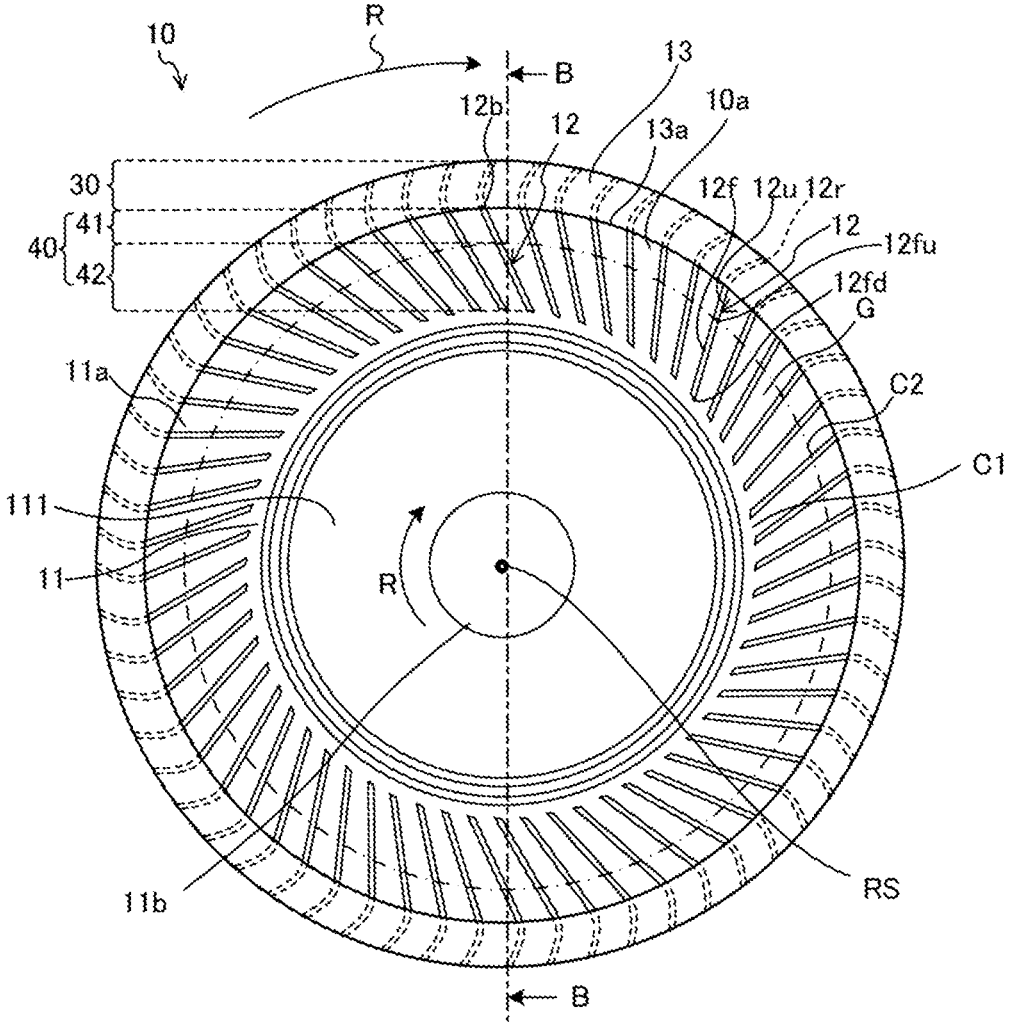
FIG. 3 is a schematic view of a configuration of an impeller of the multi-blade centrifugal air-sending device in FIG. 1 as viewed in a direction parallel to a rotational axis.
Figure 4:
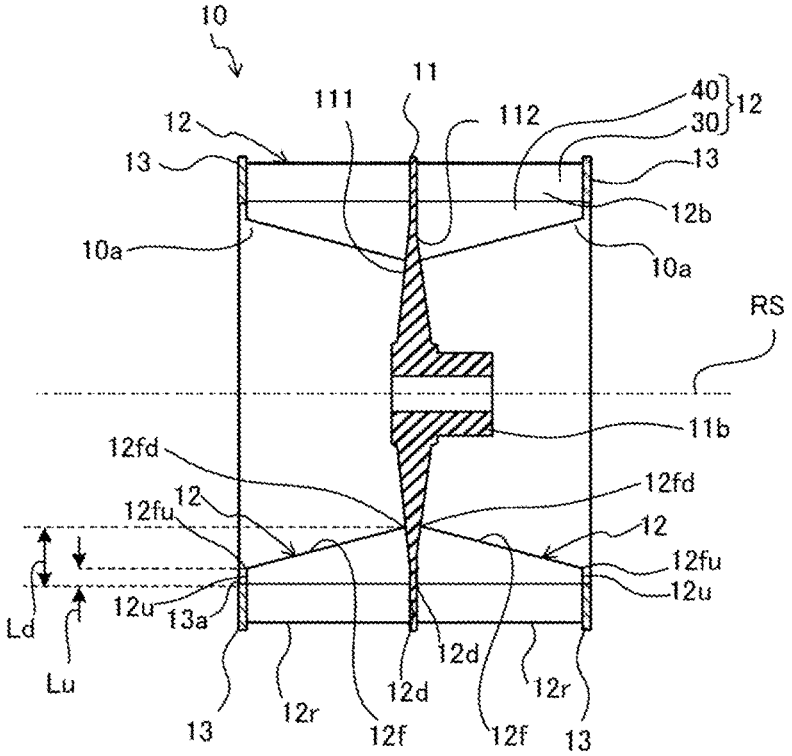
FIG. 4 is a sectional view in which a section of the impeller in FIG. 3 along line B-B is schematically illustrated.

FIG. 3 is a schematic view of a configuration of the impeller 10 of the multi-blade centrifugal air-sending device 100 in FIG. 1 as viewed in a direction parallel to the rotational axis RS. In FIG. 3, a portion of each blade 12 covered by the rim 13 is indicated by a dashed line. FIG. 4 is a sectional view in which a section of the impeller 10 in FIG. 3 along line B-B is schematically illustrated. As illustrated in FIG. 3, the impeller 10 is a centrifugal impeller. The impeller 10 is constituted by a metal and, for example, constituted by a plurality of steel sheets or other members. The impeller 10 is configured to be driven to rotate by, for example, a motor (not illustrated) and to forcibly send air in the centrifugal direction, that is, radially outward by a centrifugal force generated by rotating and suck air through the impeller air inlet 10*a* provided on the side of the rim 13. The impeller 10 is rotated by, for example, a motor in the rotational direction R.

As illustrated in FIG. 4, the back plate 11 may be formed to have a disk shape in which the wall thickness thereof increases toward the center in the radial direction with the rotational axis RS as the center, or may be formed to have a thickness that is constant in the radial direction with the rotational axis RS as the center. As long as the back plate 11 has a plate shape, the shape of the back plate 11 may be a shape other than a circular shape and may be, for example, a polygonal shape or any other shape. A motor (not illustrated) is connected to the shaft portion 11*b* provided at a center portion of the back plate 11, and the back plate 11 is driven to rotate by the motor via the shaft portion 11*b*.

As illustrated in FIG. 3, the plurality of blades 12 are disposed in the circumferential direction of a plate surface 111 of the back plate 11 with the rotational axis RS as the center such that a predetermined interval is formed between mutually adjacent blades 12. The plurality of blades 12 disposed at the back plate 11 form the cylindrical shape of the impeller 10. A gap G formed between mutually adjacent blades 12 constitutes the flow passage 11*a* of the impeller 10.

Each of the plurality of radially provided blades 12 includes a sirocco blade portion 30 constituted by a forward blade, and a turbo blade portion 40 constituted by a rearward blade. The turbo blade portion 40 is connected to the sirocco blade portion 30 in the radial direction, and each blade 12 has a shape curved in the radial direction. The turbo blade portion 40 is provided on the inner peripheral side with respect to the sirocco blade portion 30 to be continuous with the sirocco blade portion 30. The sirocco blade portion 30 and the turbo blade portion 40 are smoothly connected to each other at a blade boundary 12*b* between the sirocco blade portion 30 and the turbo blade portion 40.

As illustrated in FIG. 3 and FIG. 4, in the rotation of the back plate 11 about the rotational axis RS, an end surface of each blade 12 on the inner peripheral side is a blade leading edge 12*f*, and an end surface of each blade 12 on the outer peripheral side is a blade trailing edge 12*r*. In the following description, the blade leading edge 12*f* may be referred to as the inner peripheral edge of the blade 12. In the example illustrated in FIG. 3, the turbo blade portion 40 is linearly formed from the blade boundary 12*b* to the blade leading edge 12*f* in the radial direction. As illustrated in FIG. 4, the blade leading edge 12*f* is inclined with respect to the axial direction of the rotational axis RS such that the blade leading edge 12*f* gradually approaches the rotational axis RS from the side of the rim 13 toward the side of the back plate 11 in the axial direction of the rotational axis RS. The blade trailing edge 12*r* and the blade boundary 12*b* are each substantially parallel to the rotational axis RS. The detailed configuration of each of the blades 12 will be described later.

As illustrated in FIG. 4, each of the plurality of blades 12 is provided between the back plate 11 and the rim 13 in the axial direction of the rotational axis RS. In the axial direction of the rotational axis RS, one end of each of the blades 12 is connected to the back plate 11, and the other end of each of the blades 12 is connected to the rim 13. The other end of each of the blades 12 extends along the rim 13 in the radial direction and further extends toward the inner side than an inner peripheral end 13*a* of the rim 13. That is, a portion of the other end of each of the blades 12 on the inner peripheral side is not connected to the rim 13.

In the following description, the one end of each blade 12 connected to the back plate 11 and the other end of the blade 12 on the side of the rim 13 in the axial direction of the rotational axis RS may be referred to as an end portion 12*d* on the side of the back plate 11 and an end portion 12*u* on the side of the rim 13, respectively. In addition, in the following description, a portion of the blade leading edge 12*f* of each of the blades 12 connected to the end portion 12*d* on the side of the back plate 11 is referred to as a main-plate-side inner peripheral end 12*fd*, and a portion of the blade leading edge 12*f* of each of the blades 12 connected to the end portion 12*u* on the side of the rim 13 is referred to as a side-plate-side inner peripheral end 12*fu*. In FIG. 3, a first imaginary circle C1 passing through the side-plate-side inner peripheral ends 12*fu* of the plurality of blades 12 is indicated by a dashed dotted line. The first imaginary circle C1 has the center at the imaginary rotational axis RS of the back plate 11.

As illustrated in FIG. 4, a portion of each blade 12 extends toward the inner side further than the inner peripheral end 13*a* of the rim 13 from the side of the back plate 11 to the side of the rim 13. In other words, as illustrated in FIG. 3, not only the main-plate-side inner peripheral ends 12*fd* but also the side-plate-side inner peripheral ends 12*fu* (indicated by the first imaginary circle C1) of the blades 12 are positioned on the inner side with respect to the inner peripheral end 13*a* of the rim 13. That is, a blade portion of each blade 12 including a portion of the end portion 12*u* on the inner peripheral side and the entirety of the blade leading edge 12*f* is exposed via the inner peripheral end 13*a* of the rim 13.

The rim 13 maintains the positional relationship of the tips of the blades 12 and reinforces the plurality of blades 12. In the example illustrated in FIG. 4, the rim 13 and the plurality of blades 12 are provided on both sides of the back plate 11 in the axial direction of the rotational axis RS. The rim 13 provided to face the plate surface 111 of the back plate 11 on one side couples the plurality of blades 12 disposed on the side of the plate surface 111 of the back plate 11 on the one side to each other. The rim 13 provided to face a plate surface 112 of the back plate 11 on the other side couples the plurality of blades 12 disposed on the side of the plate surface 112 of the back plate 11 on the other side to each other.

As illustrated in FIG. 2, the impeller 10 is disposed in the scroll casing 20 such that the center of the air inlet 23*b* coincides with the center of the shaft portion 11*b* of the impeller 10 and that the rim 13 of the impeller 10 faces the side wall 23 each having the air inlet 23*b*. In the radial direction, the inner peripheral end of each of the side wall 23, that is, the opening edge of the air inlet 23*b* of the side wall 23 substantially coincides with the inner peripheral end 13*a* of the rim 13 of the impeller 10. Therefore, a blade portion of the impeller 10 extending toward the inner side further than the inner peripheral end 13*a* of the rim 13 is exposed from the inner peripheral end of the side wall 23 of the scroll casing 20.

Figure 5:
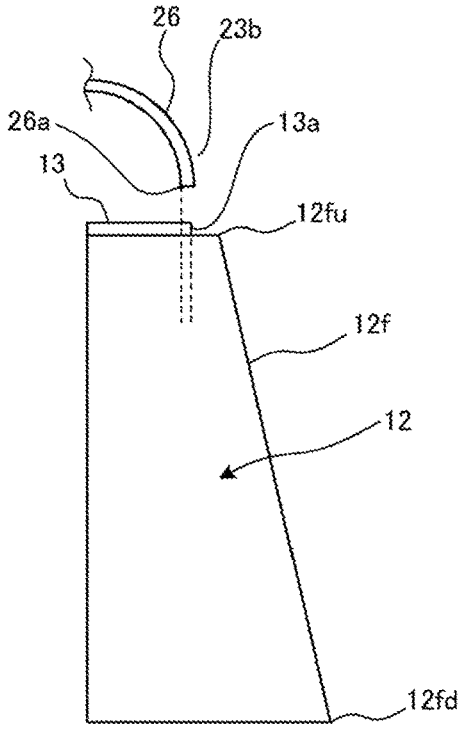
FIG. 5 schematically illustrates a positional relationship between a bell mouth and the impeller in FIG. 2.

FIG. 5 schematically illustrates a positional relationship between the bell mouth 26 and the impeller 10 in FIG. 2. As illustrated in FIG. 5, the inner peripheral end 13*a* of the rim 13 is preferably positioned on the inner peripheral side with respect to the outer peripheral end 26*a* of the tip of the bell mouth 26. With such a configuration, the length of the rim 13 in the radial direction is ensured so that the plurality of blades 12 are sufficiently fixed by the rim 13.

Figure 6:
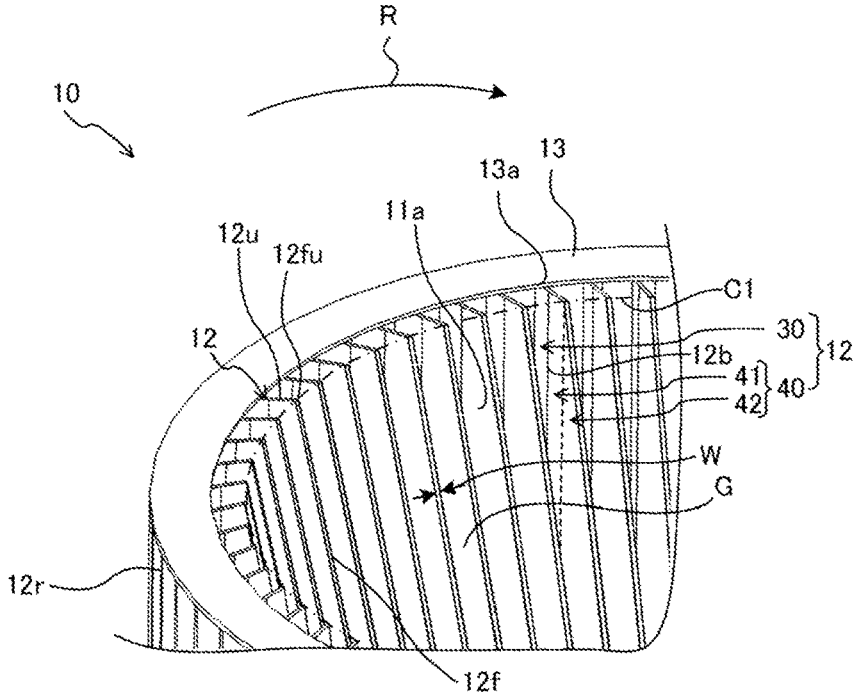
FIG. 6 is a partial perspective view in which a portion of an outer peripheral portion of the impeller in FIG. 3 is enlarged.

FIG. 6 is a partial perspective view in which a portion of an outer peripheral portion of the impeller 10 in FIG. 3 is enlarged. Hereinafter, with the side of the rim 13 and the side of the back plate 11 in the axial direction of the rotational axis RS being defined as the upper side and the lower side, respectively, a detailed configuration of the blades 12 will be described with reference to FIG. 3, FIG. 4, and FIG. 6.

As illustrated in FIG. 3, Embodiment 1 is configured such that the blade boundary 12*b* of each of the blades 12 coincides with the inner peripheral end 13*a* of the rim 13 in the radial direction, the sirocco blade portion 30 of each of the blades 12 is covered by the rim 13, and the turbo blade portion 40 of each of the blades 12 is exposed from the inner peripheral end 13*a* of the rim 13. By covering, with the rim 13, the sirocco blade portion 30 that increases the air velocity of an airflow compared with the turbo blade portion 40, it is possible to suppress an increase of noise.

As illustrated in FIG. 4, the blade leading edge 12*f* is inclined such that a distance Ld between the inner peripheral end 13*a* of the rim 13 and the main-plate-side inner peripheral end 12*fd* of the blade leading edge 12*f* is larger than a distance Lu between the inner peripheral end 13*a* of the rim 13 and the side-plate-side inner peripheral end 12*fu* of the blade leading edge 12*f*. That is, the blade leading edge 12*f* is inclined such that the inner diameter formed by the blade leading edges 12*f* of the plurality of blades 12 increases gradually from the side of the back plate 11 toward the side of the rim 13.

As illustrated in FIG. 6, the turbo blade portion 40 includes a first turbo blade portion 41 connected to the sirocco blade portion 30, and a second turbo blade portion 42 on the inner peripheral side with respect to the first turbo blade portion 41. The first turbo blade portion 41 includes the entirety of the upper surface of the turbo blade portion 40 and has, for example, a quadrangular shape such as a rectangular shape. The second turbo blade portion 42 includes the entirety of the blade leading edge 12*f* of the blade 12 and has a triangular shape. That is, the turbo blade portion 40 is formed such that the chord length of the turbo blade portion 40 increases from the side of the rim 13 toward the side of the back plate 11.

In the example illustrated in FIG. 6, in the radial direction, the side-plate-side inner peripheral end 12*fu* of the blade leading edge 12*f* is positioned on the inner side with respect to the inner peripheral end 13*a* of the rim 13, and the blade boundaries 12*b* of the blades 12 indicated by the first imaginary circle C1 are positioned at the inner peripheral end 13*a* of the rim 13. That is, in the example illustrated in FIG. 6, the entirety of the turbo blade portion 40 including the first turbo blade portion 41 and the second turbo blade portion 42 is configured to be disposed on the inner side with respect to the inner peripheral end 13*a* of the rim 13 and exposed. Meanwhile, the entirety of the upper surface of the sirocco blade portion 30 is covered by the rim 13.

In the radial direction, the position of the blade boundary 12*b* of each blade 12 does not necessarily coincide with the position of the inner peripheral end 13*a* of the rim 13. In the radial direction, as long as at least a portion of the first turbo blade portion 41 extends toward the inner side further than the inner peripheral end 13*a* of the rim 13, air can be taken from the side of the back plate 11 toward the side of the rim 13 in the flow passage 11*a* by an exposed portion of the turbo blade portion 40.

As illustrated in FIG. 3, each of the blades 12 has a wall thickness W that is constant in the radial direction. As illustrated in FIG. 6, each of the blades 12 has the wall thickness W that is constant from the side of the back plate 11 (refer to FIG. 3) to the side of the rim 13. Each of the blades 12 can be constituted by a steel sheet having a uniform thickness. That is, the wall thickness W of each blade 12 at the end portion 12*u* on the side of the rim 13 is identical to the wall thickness W of the blade 12 at the end portion 12*d* (FIG. 6) on the side of the back plate 11. Therefore, the gap G formed between adjacent blades 12 increases gradually from the blade leading edge 12*f* toward the blade trailing edge 12*r* and has the same size from the side of the back plate 11 to the side of the rim 13.

With reference to FIG. 1 to FIG. 6, operation of the multi-blade centrifugal air-sending device 100 will be described. As illustrated in FIG. 1, when the impeller 10 is driven to rotate about the rotational axis RS by a motor (not illustrated), air outside the multi-blade centrifugal air-sending device 100 flows into a central portion of the impeller 10 in the axial direction through the air inlets 23*b* of the scroll casing 20 and the impeller air inlet 10*a*. The air that has flowed into the central portion of the impeller 10 is taken into the flow passage 11*a* of the impeller 10 from the blade leading edges 12*f* due to the rotation of the impeller 10 and flows radially outward in the flow passage 11*a*.

As described with reference to FIG. 3 and FIG. 4, the portion of each blade 12 including portions on the side of the back plate 11 and the side of the rim 13 is exposed on the inner side from the inner peripheral ends of the side wall 23 and the inner peripheral end 13*a* of the rim 13. Therefore, compared with a configuration in which only a portion of each blade 12 on the side of the back plate 11 extends, the air that has flowed into a central portion of the impeller 10 can be taken into the flow passage 11*a* also from the side of the rim 13 at the blade leading edge 12*f*, and the suction air volume can be increased not only on the side of the back plate 11 but also on the side of the rim 13.

As illustrated in FIG. 4, the blade leading edge 12*f* is inclined, and the side-plate-side inner peripheral end 12*fu* is positioned on the outer side in the radial direction with respect to the main-plate-side inner peripheral end 12*fd*. It is thus possible to reduce resistance on the side of the rim 13 at the blade portion exposed from the inner peripheral end 13*a* of the rim 13 and possible to suppress an increase of noise. In addition, by reducing the resistance on the side of the rim 13 at the exposed blade portion, the inflow loss of the airflow sucked through the impeller air inlet 10*a* is reduced, and air can be induced also on the side of the back plate 11. It is thus possible to suppress a decrease in the suction air volume on the side of the back plate 11 with respect to the side of the rim 13.

As illustrated in FIG. 6, since the wall thickness W of each of the blades 12 of the impeller 10 constituted by a metal is uniform, the gap G formed between adjacent blades 12 is constant from the side of the back plate 11 to the side of the rim 13. Therefore, compared with an impeller constituted by a resin material as in the related art and in which the gap G is narrow on the side of the back plate 11, the suction air volume can be increased also on the side of the back plate 11 in the impeller 10.

As illustrated in FIG. 6, the turbo blade portion 40 is provided on the inner side of the sirocco blade portion 30 in the radial direction in each blade 12, and the turbo blade portion 40 is configured to be exposed from the inner peripheral end 13*a* of the rim 13. Therefore, the air that has been taken into the flow passage 11*a* formed by the turbo blade portion 40 and inclining in a direction opposite to the rotation direction of the impeller while gradually expanding toward the sirocco blade portion 30 is sent to the sirocco blade portion 30 while being efficiently pressurized.

The pressurized airflow that has reached the blade boundary 12*b* with respect to the sirocco blade portion 30 then flows along the sirocco blade portion 30 in the flow passage 11*a* toward the blade trailing edge 12*r* while changing the traveling direction thereof. Thereafter, the airflow that has reached the blade trailing edge 12*r* is sent to the air passage 20*a* of the scroll casing 20 from the flow passage 11*a* of the impeller 10. The airflow that has been sent to the air passage 20*a* from the impeller 10 is further pressurized when passing through the air passage 20*a* that has a spiral shape and that expands toward the discharge port 22*b* and is blown out to the outer peripheral side through the discharge port 22*b*.

In Embodiment 1, the multi-blade centrifugal air-sending device 100 that is a double-suction-type centrifugal air-sending device has been described. The multi-blade centrifugal air-sending device 100, however, may be a single-suction-type centrifugal air-sending device. The number of the blades 12 is not limited to that in the drawings.

As described above, the multi-blade centrifugal air-sending device 100 according to Embodiment 1 includes the impeller 10, and the spiral scroll casing 20 housing the impeller 10. The impeller 10 includes the back plate 11 having a disk shape; the plurality of blades 12 arranged at the peripheral portion of the back plate 11 in the circumferential direction; and the annular rim 13 disposed to face the back plate 11 and fixing the plurality of blades 12. The scroll casing 20 is configured such that air is introduced from the side of the rim 13 and blown out to the outer peripheral side. The impeller 10 is constituted by a metal, and each blade 12 has the wall thickness W that is constant from the side of the back plate 11 to the side of the rim 13. Each blade 12 extends toward the inner side further than the inner peripheral end 13*a* of the rim 13 from the side of the back plate 11 to the side of the rim 13.

According to the present disclosure, since the impeller 10 is constituted by a metal and the wall thickness W of each blade 12 is constant from the side of the rim 13 to the side of the back plate 11, it is possible to ensure the gap G that is the same as that on the side of the rim 13 also on the side of the back plate 11 in the impeller 10. Therefore, compared with a multi-blade centrifugal air-sending device that is a resin molded product as in the related art, the suction air volume can be increased also on the side of the back plate 11 in the impeller 10.

The inner peripheral edge (blade leading edge 12*f*) of each blade 12 is inclined from the side of the rim 13 toward the side of the back plate 11. The distance Ld between the inner peripheral end 13*a* of the rim 13 and the inner peripheral end (main-plate-side inner peripheral end 12*fd*) of the blade leading edge 12*f* on the side of the back plate 11 is larger than the distance Lu between the inner peripheral end 13*a* of the rim 13 and the inner peripheral end (side-plate-side inner peripheral end 12*fu*) of the blade leading edge 12*f* on the side of the rim 13. In other words, the blade leading edge 12*f* is inclined such that a distance in the radial direction between the main-plate-side inner peripheral end 12*fd* and the rotational axis RS (or a perpendicular line extending from the inner peripheral end 13*a* of the rim 13 to the back plate 11) of the impeller 10 is larger than a distance in the radial direction between the side-plate-side inner peripheral end 12*fu* and the rotational axis RS (or a perpendicular line extending from the inner peripheral end 13*a* of the rim 13 to the back plate 11) of the impeller 10.

Consequently, it is possible to reduce the resistance generated on the side of the rim 13 at the blade portion exposed from the inner peripheral end 13*a* of the rim 13 and possible to suppress the inflow loss of the air flowing in through the impeller air inlet 10*a* and generation of, for example, a noise increase due to resistance. It is thus possible to induce the air that flows in through the impeller air inlet 10*a* also to the side of the back plate 11 and possible to suppress a decrease in the suction air volume on the side of the back plate 11 with respect to the side of the rim 13.

Each blade 12 includes the sirocco blade portion 30 constituted by the forward blade, and the turbo blade portion 40 connected to the inner peripheral side of the sirocco blade portion 30 and constituted by the rearward blade. The turbo blade portion 40 of each blade 12 is provided on the inner side with respect to the inner peripheral end 13*a* of the rim 13. Consequently, the area of the exposed blade portion can be further increased, and an increased amount of the air that flows in through the impeller air inlet 10*a* can be taken into the gap G between the blades 12. In addition, the air that has been taken into the flow passage 11*a* formed by the turbo blade portion 40 and inclining in the direction opposite to the rotational direction R of the impeller 10 while expanding gradually toward the outer side in the radial direction can be sent to the sirocco blade portion 30 highly efficiently while being pressurized.

The scroll casing 20 includes the two facing side walls 23 in each of which the air inlet 23*b* is provided, the peripheral wall 24, and the bell mouth 26 forming the air inlet 23*b* and whose opening diameter gradually decreases toward the inside. The inner peripheral end 13*a* of the rim 13 is positioned on the inner peripheral side with respect to the outer peripheral end 26*a* of the tip of the bell mouth 26. Consequently, the length of the rim 13 in the radial direction is ensured, and the plurality of blades 12 can be more reliably fixed by the rim 13.

Embodiment 2

Figure 7:
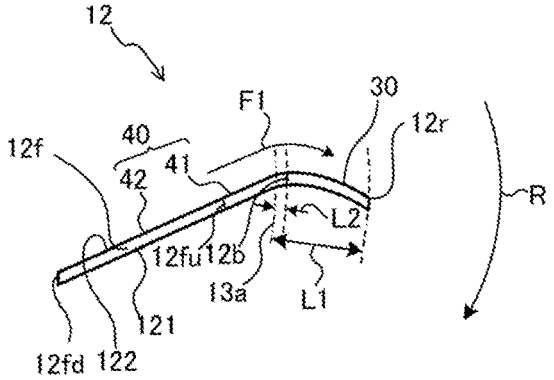
FIG. 7 is a schematic view of a configuration of a blade of a multi-blade centrifugal air-sending device according to Embodiment 2 as viewed in a direction parallel to a rotational axis.

FIG. 7 is a schematic view of a configuration of a blade of a multi-blade centrifugal air-sending device according to Embodiment 2 as viewed in a direction parallel to a rotational axis. Embodiment 2 differs from Embodiment 1 in that, when each blade 12 is viewed in the axial direction of the rotational axis RS of the impeller 10, a portion of the first turbo blade portion 41 is covered by the rim 13. In FIG. 7, the position of the inner peripheral end 13*a* of the rim 13 with respect to each blade 12 set at the plate surface 111 (refer to FIG. 3) of the back plate 11 is indicated by a dashed double-dotted line. In addition, in FIG. 7, the direction of the airflow passing the vicinity of a suction surface 122 of each blade 12 during rotation of the impeller 10 is indicated by the arrow F1.

Also in Embodiment 2, the first turbo blade portion 41 includes the entirety of the upper surface of the turbo blade portion 40 and has a quadrangular shape, and the second turbo blade portion 42 includes the entirety of the blade leading edge 12*f* of the blade 12 and has a triangular shape, as in Embodiment 1. In Embodiment 2, the side-plate-side inner peripheral end 12*fu* of the blade leading edge 12*f* at the boundary between the first turbo blade portion 41 and the second turbo blade portion 42 is positioned on the inner side with respect to the position of the inner peripheral end 13*a* of the rim 13, as in Embodiment 1.

In Embodiment 2, the blade boundary 12*b* between the sirocco blade portion 30 and the first turbo blade portion 41 of the turbo blade portion 40 is positioned on the outer side with respect to the position of the inner peripheral end 13*a* of the rim 13, and the sirocco blade portion 30 and a portion of the first turbo blade portion 41 on the outer peripheral side are configured to be covered by the rim 13. In other words, a portion of each blade 12 covered by the rim 13 is constituted by the sirocco blade portion 30 and a portion of the first turbo blade portion 41 on the outer peripheral side.

Therefore, the volume of air sucked into the flow passage 11*a* can be increased by the portion of the turbo blade portion 40 exposed from the rim 13, and the airflow sucked into the flow passage 11*a* can be efficiently pressurized by the portion of the turbo blade portion 40 covered by the rim 13.

When viewed in the axial direction of the rotational axis RS of the impeller 10, the percentage of a chord length L2 of the portion of the first turbo blade portion 41 covered by the rim 13 with respect to a chord length L1 of the portion of each blade 12 covered by the rim 13 is preferably larger than 0% and less than or equal to 30%.

Figure 8:
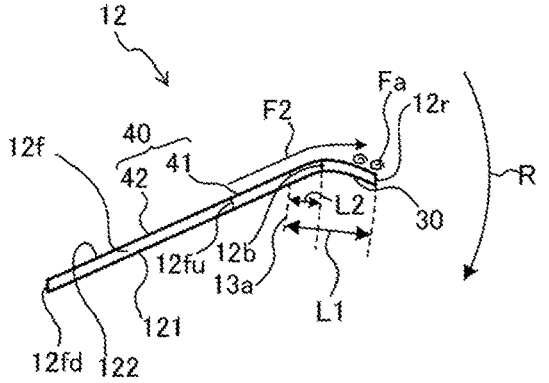
FIG. 8 is a view of a modification of the blade in FIG. 7.

FIG. 8 is a view of a modification of the blade 12 in FIG. 7. In the modification illustrated in FIG. 8, the percentage of the chord length L2 of the portion of the first turbo blade portion 41 covered by the rim 13 with respect to the chord length L1 of the portion of each blade 12 covered by the rim 13 is 40%, which is larger than 30%. To set the percentage of the chord length L2 with respect to the chord length L1 to more than 30% as in the modification, when the blade chord length of each blade 12 is constant, it is necessary to decrease the chord length of the sirocco blade portion 30 and further incline the sirocco blade portion 30 with respect to the turbo blade portion 40 in the rotational direction R. Consequently, a separation vortex Fa may be generated on the side of the suction surface 122 of the sirocco blade portion 30, which may lead to a decrease in the air volume as a result of the airflow separating from the suction surface 122 and to an increase of noise due to the generation of the separation vortex Fa.

In Embodiment 2, each blade 12 includes the sirocco blade portion 30 constituted by the forward blade, and the turbo blade portion 40 connected to the inner peripheral side of the sirocco blade portion 30 and constituted by the rearward blade. When viewed in the axial direction of the rotational axis RS of the impeller 10, the portion of each blade 12 covered by the rim 13 is constituted by the sirocco blade portion 30 and a portion of the turbo blade portion 40. The chord length of the sirocco blade portion 30, that is, the difference between the chord length L1 and the chord length L2 is larger than the chord length L2 of a portion of the turbo blade portion 40. Further, the percentage of the chord length L2 of the portion (the portion of the turbo blade portion 40 described above) of the turbo blade portion 40 covered by the rim 13 with respect to the chord length L1 of the portion of each blade 12 covered by the rim 13 is more than 0% and less than or equal to 30%.

Consequently, when an airflow F2 flows from the turbo blade portion 40 to the sirocco blade portion 30, a sudden change in the angle of the airflow can be suppressed in a process in which the angle of each blade 12 changes. It is thus possible to suppress separation occurring at the suction surface 122. As a result, it is possible to suppress a decrease in the air volume due to the airflow separating from the suction surface 122 and an increase of noise due to generation of the separation vortex Fa.

Note that the embodiments can be combined together, and modifications and omissions can be performed, as appropriate, in each embodiment.

The invention claimed is:

1. A multi-blade centrifugal air-sending device comprising:

an impeller including a back plate having a disk shape, a plurality of blades arranged at a peripheral portion of the back plate in a circumferential direction, and a rim having an annular shape and disposed to face the back plate, the rim fixing the plurality of blades; and a scroll casing having a spiral shape and housing the impeller, the scroll casing being configured such that air is introduced from a side of the rim and blown out to an outer peripheral side, wherein each of the blades includes a sirocco blade portion constituted by a forward blade, and a turbo blade portion constituted by a rearward blade and connected to an inner peripheral side of the sirocco blade portion, wherein the impeller is constituted by a metal, wherein each of the blades has a wall thickness constant from a side of the back plate to the side of the rim in an axial direction of a rotational axis of the impeller and each of the blades from the side of the back plate to the side of the rim extends toward an inner side further than an inner peripheral end of the rim in a radial direction of the rotational axis, wherein, when viewed in an axial direction of a rotational axis of the impeller, a portion of each of the blades covered by the rim is constituted by the sirocco blade portion and a portion of the turbo blade portion, and wherein a chord length of the sirocco blade portion is larger than a chord length of the portion of the turbo blade portion.

2. The multi-blade centrifugal air-sending device of claim 1, wherein a percentage of the chord length of the portion of the turbo blade portion with respect to a chord length of the portion of each of the blades is larger than 0% and less than or equal to 30%.

3. The multi-blade centrifugal air-sending device of claim 1, wherein the scroll casing includes two facing sidewalls in each of which an air inlet is provided, a peripheral wall, and a bell mouth forming the air inlet and having an opening diameter gradually decreasing toward an inside, and wherein the inner peripheral end of the rim is positioned on an inner peripheral side with respect to an outer peripheral end of a tip of the bell mouth.

* * * * *